US010098490B1

(12) United States Patent
Shamas

(10) Patent No.: US 10,098,490 B1
(45) **Date of Patent: *Oct. 16, 2018**

(54) FLEXIBLE MAILBOX SUPPORT

(71) Applicant: The Spectrum Services Company Inc., Meriden, CT (US)

(72) Inventor: Matthew M. Shamas, Meriden, CT (US)

(73) Assignee: The Spectrum Services Company Inc., Meriden, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/892,110

(22) Filed: Feb. 8, 2018

Related U.S. Application Data

(63) Continuation of application No. 15/666,182, filed on Aug. 1, 2017, now Pat. No. 9,924,821.

(60) Provisional application No. 62/522,194, filed on Jun. 20, 2017.

(51) Int. Cl.
*A47G 29/12* (2006.01)

(52) U.S. Cl.
CPC ..... *A47G 29/1216* (2013.01)

(58) Field of Classification Search
CPC . A47G 29/1216; F16M 11/40; E04H 12/2215
USPC ..... 232/39; 248/160, 156, 900
See application file for complete search history.

(56) References Cited

U.S. PATENT DOCUMENTS

| | | | | |
|---|---|---|---|---|
| 2,949,324 | A * | 8/1960 | Birge | E01F 9/627 248/576 |
| 4,491,438 | A | 1/1985 | Berutti | |
| 4,792,088 | A | 12/1988 | Bonnell | |
| 5,029,783 | A | 7/1991 | Alvarez | |
| 5,042,716 | A | 8/1991 | Robbins | |
| 5,400,959 | A | 3/1995 | Cone | |
| 6,223,982 | B1 | 5/2001 | Dunn | |
| 6,969,212 | B1 | 11/2005 | Richens et al. | |
| 7,032,811 | B1 | 4/2006 | Paulic et al. | |
| 7,108,445 | B2 | 9/2006 | Henriques | |
| 7,832,695 | B2 | 11/2010 | Ebel et al. | |
| 9,433,313 | B2 | 9/2016 | Lenz, Jr. | |
| 2010/0237143 | A1 | 9/2010 | LaBrecque, Jr. | |
| 2014/0021311 | A1 | 1/2014 | Lenz, Jr. | |

* cited by examiner

*Primary Examiner* — William L Miller
(74) *Attorney, Agent, or Firm* — Whitmyer IP Group LLC

(57) ABSTRACT

A flexible mailbox support on which a mailbox is mounted includes a top end portion, a bottom end portion, and a joint configured to enable the top end portion to pivot relative to the bottom end portion when impacted by a force, such that respective longitudinal axes of top and bottom end portions of the support are angularly offset relative to one another. The joint includes a top joint housing, a bottom joint housing, a joint spring connected between the top joint housing and the bottom joint housing, and a safety cable connecting the top joint housing and the bottom joint housing.

18 Claims, 8 Drawing Sheets

FLEXIBLE MAILBOX SUPPORT

CROSS-REFERENCE TO RELATED APPLICATIONS

This disclosure is a continuation of pending U.S. application Ser. No. 15/666,182, filed Aug. 1, 2017, which claims priority to U.S. Provisional Patent Application No. 62/522,194, filed Jun. 20, 2017, the contents of which are incorporated herein by reference in their entirety.

TECHNICAL FIELD

Aspects of the present invention relates to a flexible mailbox support, and a system that includes the flexible mailbox support and a mailbox mounted thereon.

BACKGROUND

Referring to FIG. 1, it is known to mount a mailbox 2 on a mailbox support 4. The mailbox 2 includes a mail receptacle 6. The mailbox support 4 is typically in the form of an elongated rigid member (e.g., a beam, a pole, a post, a shaft, etc.). There is a reasonable likelihood that, over the course of their lifetime, the mailbox 2 and/or the mailbox support 4 will be impacted by an automobile, a snow plow, and/or a teenage vandal wielding a baseball bat. Such impacts can seriously damage and/or destroy the mailbox 2 and/or the mailbox support 4, and can require costly and burdensome repairs and/or replacement.

To overcome these problems, attempts have been made to make mailboxes and mailbox supports more durable and thus more capable of withstanding such impacts. For example, it is known to make mailboxes and mailbox supports out of plastic materials rather than metal and/or wood materials. However, mailboxes and mailbox supports made from plastic material can be unsightly. As another example, U.S. Pat. No. 9,433,313 (the "'313 Patent") discloses a mailbox support that includes a spring connected between top and bottom end portions of the mailbox support to permit the top end portion to pivot relative to the bottom end portion upon impact. The mailbox support disclosed in the '313 Patent can be problematic in several ways. First, if the impact is great enough, the top end portion of the mailbox support (and thus the mailbox mounted thereon) can break away from the spring. This can create a dangerous situation if the top end portion winds up in a street where automobiles are travelling. Second, the spring permits pivoting of the top end portion in all directions (i.e., in 360 degrees about a longitudinal axis of the bottom end portion). In some instances, a dangerous situation could occur if the top end portion of the mailbox support pivots in a particular direction (e.g., in the direction of an adjacent sidewalk where pedestrians and/or cyclists are travelling).

Aspects of the present invention are directed to these and other problems.

SUMMARY

According to an aspect of the present invention, a flexible mailbox support is provided on which a mailbox can be mounted. The flexible mailbox support includes a top end portion, a bottom end portion, and a joint configured to enable the top end portion to pivot relative to the bottom end portion when impacted by a force, such that respective longitudinal axes of top and bottom end portions of the support are angularly offset relative to one another. The joint includes a top joint housing, a bottom joint housing, a joint spring connected between the top joint housing and the bottom joint housing, and a safety cable connecting the top joint housing and the bottom joint housing.

According to another aspect of the present invention, a system includes a mailbox and a flexible mailbox support on which the mailbox can be mounted. The flexible mailbox support includes a top end portion, a bottom end portion, and a joint configured to enable the top end portion to pivot relative to the bottom end portion when impacted by a force, such that respective longitudinal axes of top and bottom end portions of the support are angularly offset relative to one another. The joint includes a top joint housing, a bottom joint housing, a joint spring connected between the top joint housing and the bottom joint housing, and a safety cable connecting the top joint housing and the bottom joint housing.

In addition to, or as an alternative to, one or more of the features described above, further aspects of the present invention can include one or more of the following features, individually or in combination:

- wherein the joint enables the flexible mailbox support to move between an unbent state and a bent state, wherein in the unbent state, the respective longitudinal axes of the top and bottom end portions of the flexible mailbox support are at least substantially aligned with one another, and wherein in the bent state, the respective longitudinal axes of the top and bottom end portions of the flexible mailbox support are angularly offset relative to one another;
- wherein the top and bottom joint housings of the joint each include a base plate and one or more sidewalls that extend from the base plate to define a cavity;
- wherein the top end portion of the flexible mailbox support is received within the cavity of the top joint housing, and the bottom end portion of the flexible mailbox support is received within the cavity of the bottom joint housing;
- wherein the sidewalls are configured to flex relative to the respective base plates;
- wherein the top and bottom joint housings each have a square cross-sectional shape defined by respective sidewalls thereof;
- wherein each of the respective sidewalls is separated from an adjacent sidewall by a gap;
- wherein fasteners are positioned on each of the four sides of the respective sidewalls, and wherein the safety cable is removably connectable to different sides of the top and bottom joint housings depending on a desired orientation of a pivot area of the flexible mailbox support;
- wherein the joint spring is welded between the respective base plates of the top and bottom joint housings;
- wherein each of the sidewalls includes at least one hole configured to receive a lag bolt, and each end of the safety cable has a loop configured to be connected to the lag bolt;
- wherein the safety cable is connected to the top and bottom joint housings via fasteners;
- wherein the safety cable has a length and a strength sufficient to prevent the top end portion of the flexible mailbox support from pivoting relative to the bottom end portion in a direction perpendicular to the respective surfaces of the sidewalls that are opposite the safety cable, and wherein the top end portion of the flexible mailbox support is pivotable relative to the bottom end portion in all other directions not constrained by the safety cable;

wherein the top end portion is pivotable within a semicircular pivot area having a radius;

wherein the joint is a first joint and the flexible mailbox support further comprises a second joint, and wherein the first joint extends between the top end portion and an intermediate portion of the flexible mailbox support, and the second joint extends between the intermediate portion and the bottom end portion of the flexible mailbox support;

wherein the flexible mailbox support has a total height that is substantially equal to a sum of the respective heights of the bottom end portion of, the top end portion, and the joint, and wherein the height of the top end portion is greater than the height of the bottom end portion; and wherein the flexible mailbox support has a total height that is substantially equal to a sum of the respective heights of the bottom end portion of, the top end portion, and the joint, and wherein the height of the top end portion is less than the height of the bottom end portion.

These and other aspects of the present invention will become apparent in light of the drawings and detailed description provided below.

DETAILED DESCRIPTION

Figure 1:
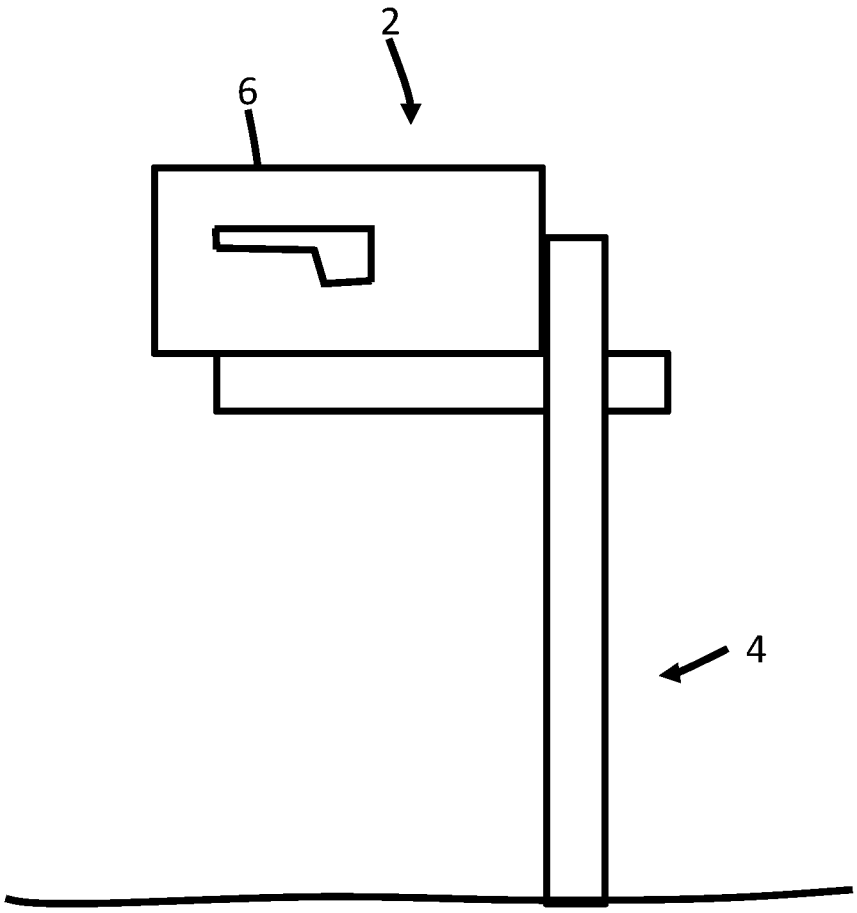
FIG. 1 PRIOR ART
FIG. 1 is an elevation view of a mailbox mounted on a prior art rigid mailbox support.
Figure 2:
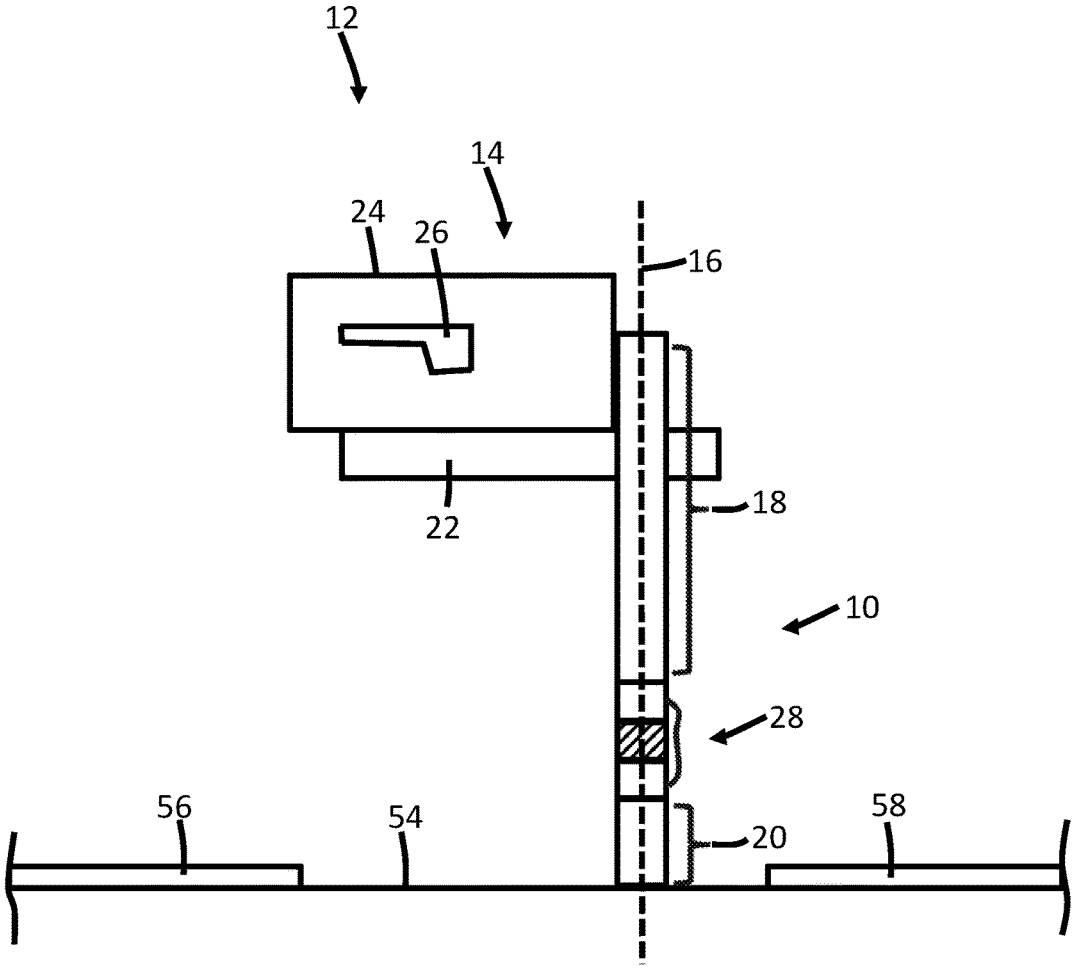
FIG. 2 is an elevation view of a mailbox mounted on the present flexible mailbox support.

Referring to FIG. 2, the present disclosure relates to a flexible mailbox support 10 (hereinafter the "support 10"), and a system 12 that includes the support 10 and a mailbox 14 mounted thereon.

The support 10 extends along a longitudinal axis 16 between a top end portion 18 and an opposing bottom end portion 20 of the support 10. The mailbox 14 is mounted to the top end portion 18 (e.g., via a horizontal arm 22), and the bottom end portion 20 is positionally fixed relative to the ground (e.g., via cement). In the illustrated embodiments, the mailbox 14 includes a mail receptacle 24 configured to receive incoming mail from a mail carrier, and a flag 26 attached to the mail receptacle 24 and configured to be raised to indicate the presence of outgoing mail to the mail carrier.

Referring still to FIG. 2, the support 10 includes a flexible support joint 28 (hereinafter the "joint 28") between the top and bottom end portions 18, 20 of the support 10. The joint 28 enables the top end portion 18 to pivot relative to the bottom end portion 20 when the top end portion 18, and/or the mailbox 14 mounted thereto, is impacted by a force. The joint 28 thereby enables the support 10 (and thus the system 12 as a whole) to move between an unbent state (see FIG. 2) and a bent state (not shown). In the unbent state, respective longitudinal axes of the top and bottom end portions 18, 20 of the support 10 are at least substantially aligned with one another (e.g., aligned in an at least substantially vertical direction perpendicular to a plane defined by the ground). In the bent state, respective longitudinal axes of top and bottom end portions 18, 20 of the support 10 are angularly offset relative to one another.

Figure 3:
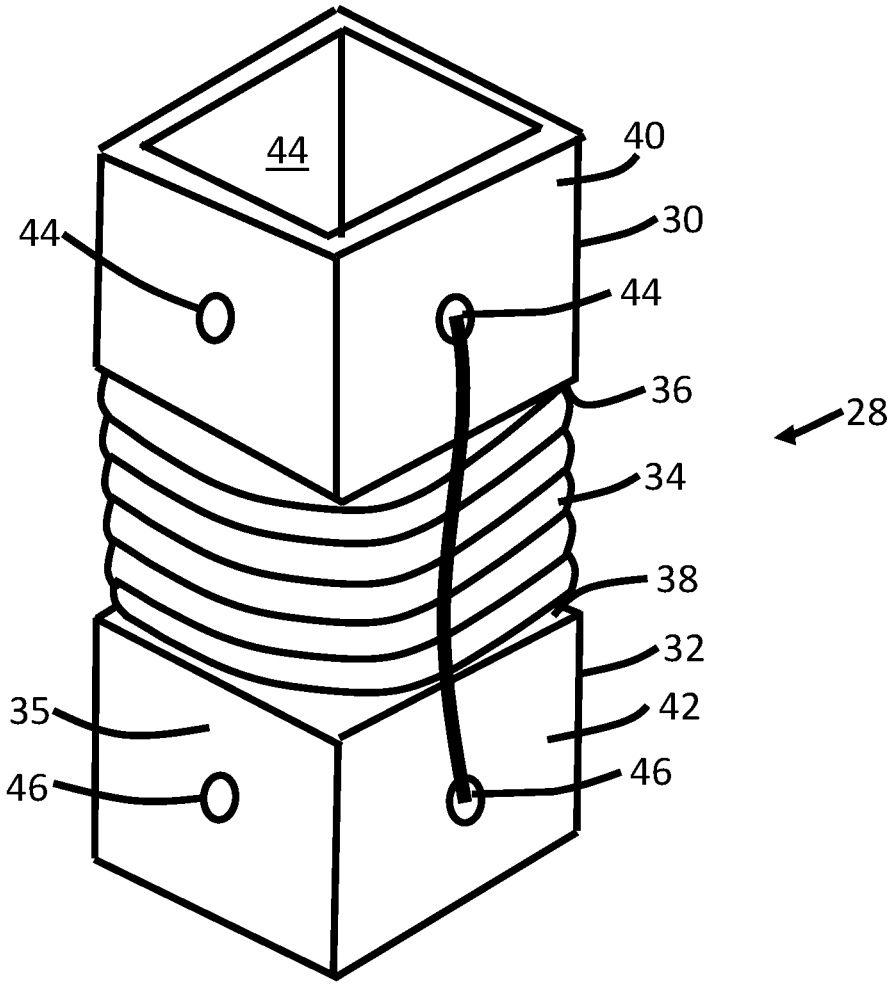
FIG. 3 is a perspective view of the flexible joint of the flexible mailbox support of FIG. 2.

Referring to FIG. 3, the joint 28 includes a top joint housing 30, a bottom joint housing 32, a joint spring 34 connected (e.g., connected via welding) between the top and bottom joint housings 30, 32, and at least one safety cable 35 connecting the top and bottom joint housings 30, 32.

Referring to FIG. 3, the top and bottom joint housings 30, 32 each include a base plate 36, 38 and a sidewall 40, 42 that extends from the base plate 36, 38 to define a cavity (see, e.g., the cavity 44 of the top joint housing 30 in FIG. 3). The joint spring 34 is welded between the respective base plates 36, 38 of the top and bottom joint housings 30, 32.

Figure 4:
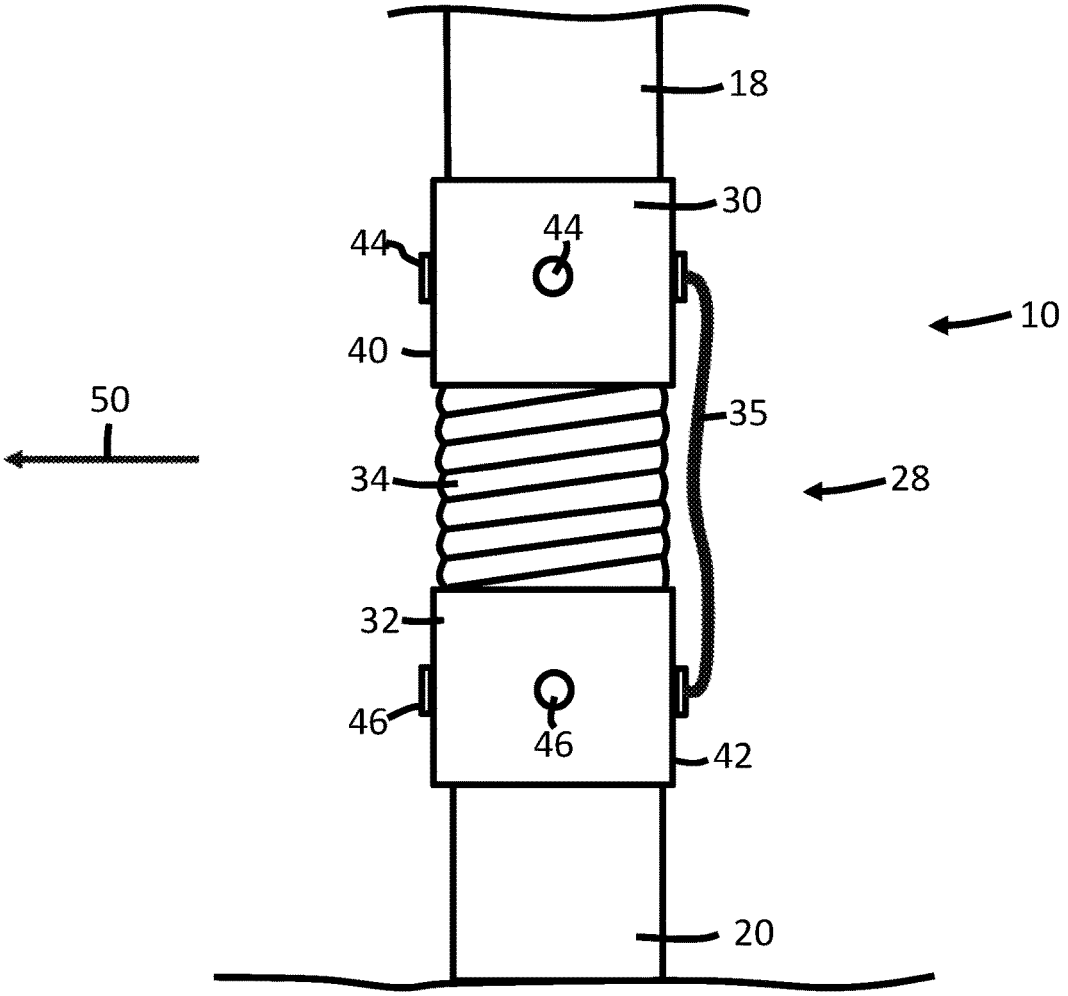
FIG. 4 is a partial elevation view of the flexible mailbox support of FIG. 2.

Referring to FIG. 4, the top end portion 18 of the support 10 is received within the cavity 44 of the top joint housing 30 and held in place via a first shim (not shown). Similarly, the bottom end portion 20 of the support 10 is received within the cavity (not shown) of the bottom joint housing 32 and held in place via a second shim (not shown).

Figure 6:
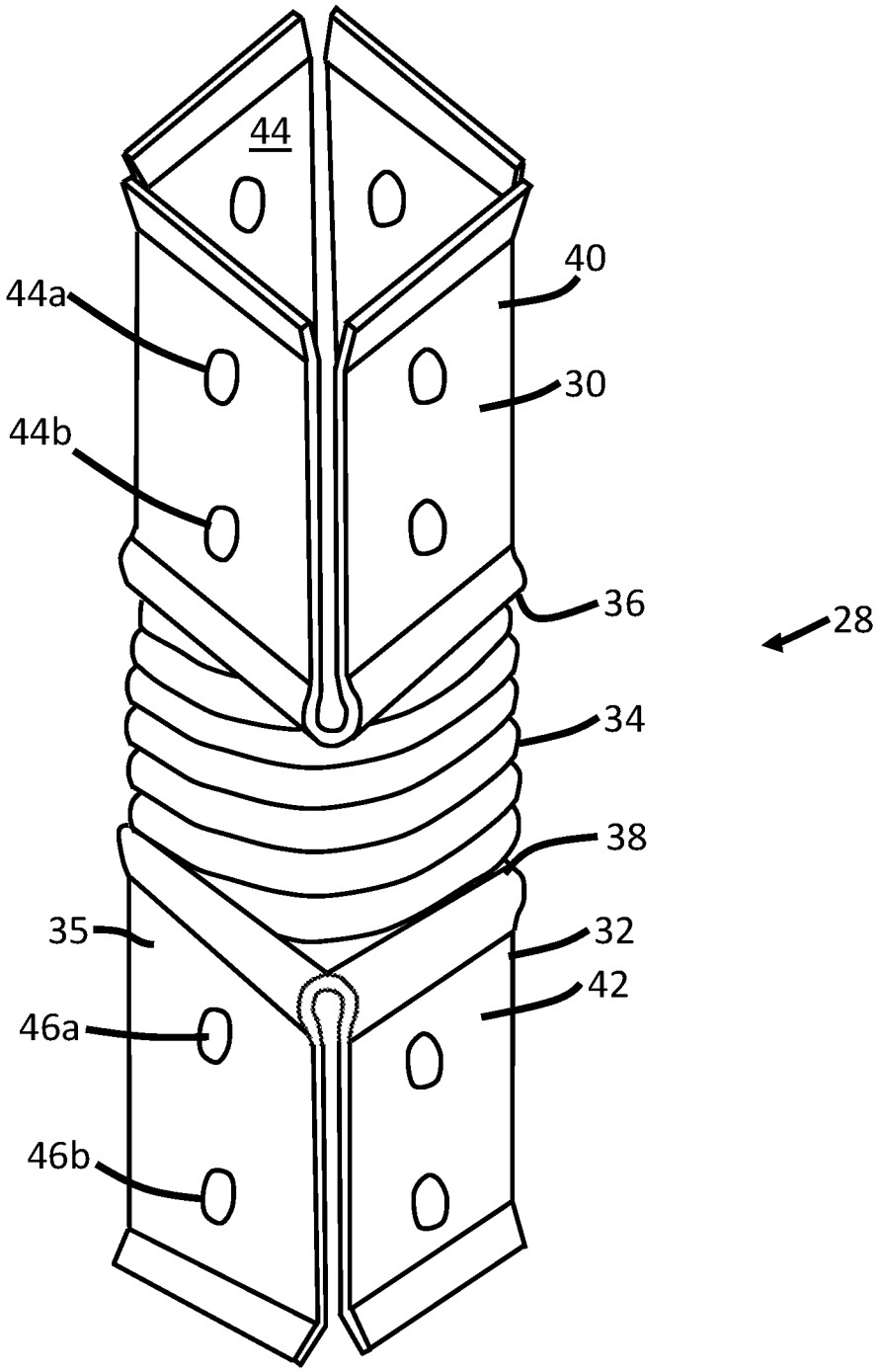
FIG. 6 is a perspective view of a flexible joint of another flexible mailbox support.

Referring to FIGS. 3 and 4, the safety cable 35 is connected (e.g., removably connected) to the top and bottom joint housings 30, 32 via fasteners 46, 48 (e.g., screws, hooks, bolts, etc.). In embodiment illustrated in FIGS. 3 and 4, the top and bottom joint housings 30, 32 each have a 4"×4" square cross-sectional shape defined by the respective sidewalls 40, 42 thereof, and the fasteners 46, 48 are positioned on each of the four sides of the respective sidewalls 40, 42. In the embodiment illustrated in FIG. 6, the square cross-sectional shape defined by the respective sidewalls 40, 42 of the top and bottom joint housings 30, 32 is nominally 4"×4" in size, but the sidewalls 40, 42 are designed to flex somewhat relative to the respective base plates 36, 38. This makes the square cross-sectional shape defined by the respective sidewalls 40, 42 adjustable enough to accept all odd-shaped 4"×4" posts, especially after the shrinking of pressure treated wood due to exposure to environment. The flex is possible due to the fact that each of the four sides of the sidewalls 40, 42 are separated from adjacent sides by a gap, and because the sidewalls 40, 42 and the respective base plates 36, 38 have rounded connections that permit flexing of the sidewalls 40, 42 relative to the respective base plates 36, 38. The embodiment illustrated in FIG. 6 is also distinguishable from the embodiment illustrated in FIG. 3 in that the four sides of the sidewalls 40, 42 each include a first fastener 44*a*, 46*a* and a second fastener 44*b*, 46*b* in the form of a hole through which a lag bolt (not shown) is passed to connect with the respective top and bottom end portions 18, 20 of the support 10. The ends of the safety cable 35 can have loops are connected to the lag bolts.

Figure 5:
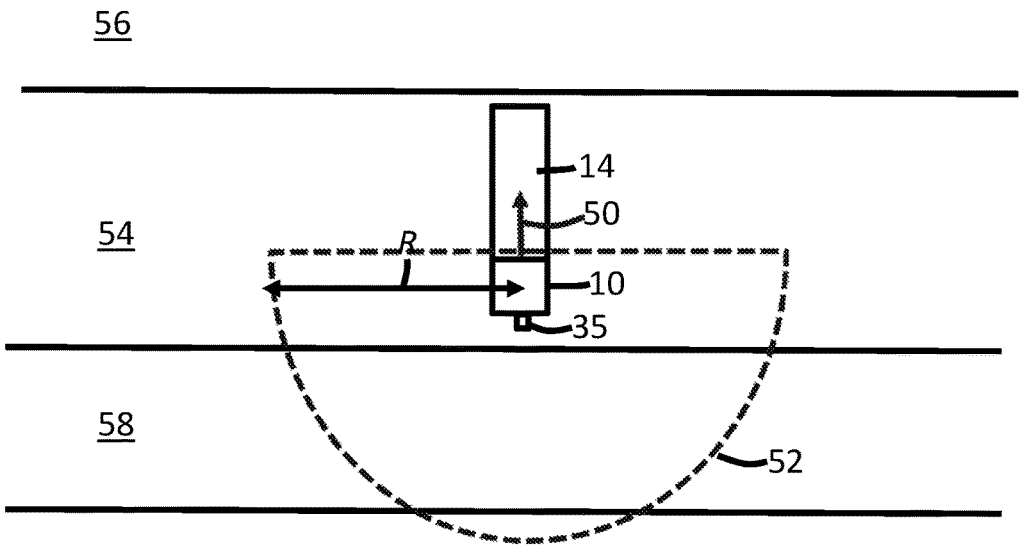
FIG. 5 is a schematic plan view of the mailbox and flexible mailbox support of FIG. 2.

Referring to FIGS. 4 and 5, the safety cable 35 has a dimension (e.g., a length) and strength sufficient to prevent the top end portion 18 of the support 10 from pivoting relative to the bottom end portion 20 in a direction 50 perpendicular to the respective surfaces of the sidewalls 40, 42 that are opposite the safety cable 35. The top end portion 18 of the support 10 is able to pivot relative to the bottom end portion 20 in all other directions not constrained by the safety cable 35. Referring to FIG. 5, in the illustrated embodiment, the result is that the top end portion 18 is able to pivot within a semicircular pivot area 52 having a radius R. Because fasteners 46, 48 are positioned on each of the four sides of the respective sidewalls 40, 42, the safety cable 35 can be removably connected to different sides of the top and bottom joint housings 30, 32 depending on the desired orientation of the semicircular pivot area 52. In the illustrated embodiments, for example, the system 12 (i.e., the support 10 and the mailbox 14) is positioned on a strip of grass 54 between a road 56 and a sidewalk 58. The safety cable 35 is connected to the respective sides of the top and bottom joint housings 30, 32 opposite the road 56 so that the semicircular pivot area 52 does not overlap with the road 56. This orientation ensures that the top end portion 18 of the support 10 will not pivot into automobiles and/or cyclists travelling on the road 56.

The safety cable 35 is also advantageous in that it anchors the top end portion 18 of the support 10 to the bottom end portion 20 of the support 10. If an impact on the top end portion 18 of the support 10 is great enough that the connection between the joint spring 34 and the base plate 36 of the top joint housing 30 breaks, the top end portion 18 of the support 10 should still remain connected to the bottom end portion 20 of the support 10 via the safety cable 35 and the bottom joint housing 32 of the joint 28. The safety cable 35 can thus prevent a potentially dangerous situation in which the top end portion 18 of the support 10 (and the mailbox 14 mounted thereon) breaks free from the bottom end portion 20 of the support 10 and winds up in a street where automobiles are travelling. This is especially true in embodiments such as that shown in FIG. 6, in which the safety cable 35 is connected directly to the top and bottom end portions 18, 20 of the support 10 via lag bolts (not shown).

Figure 7:
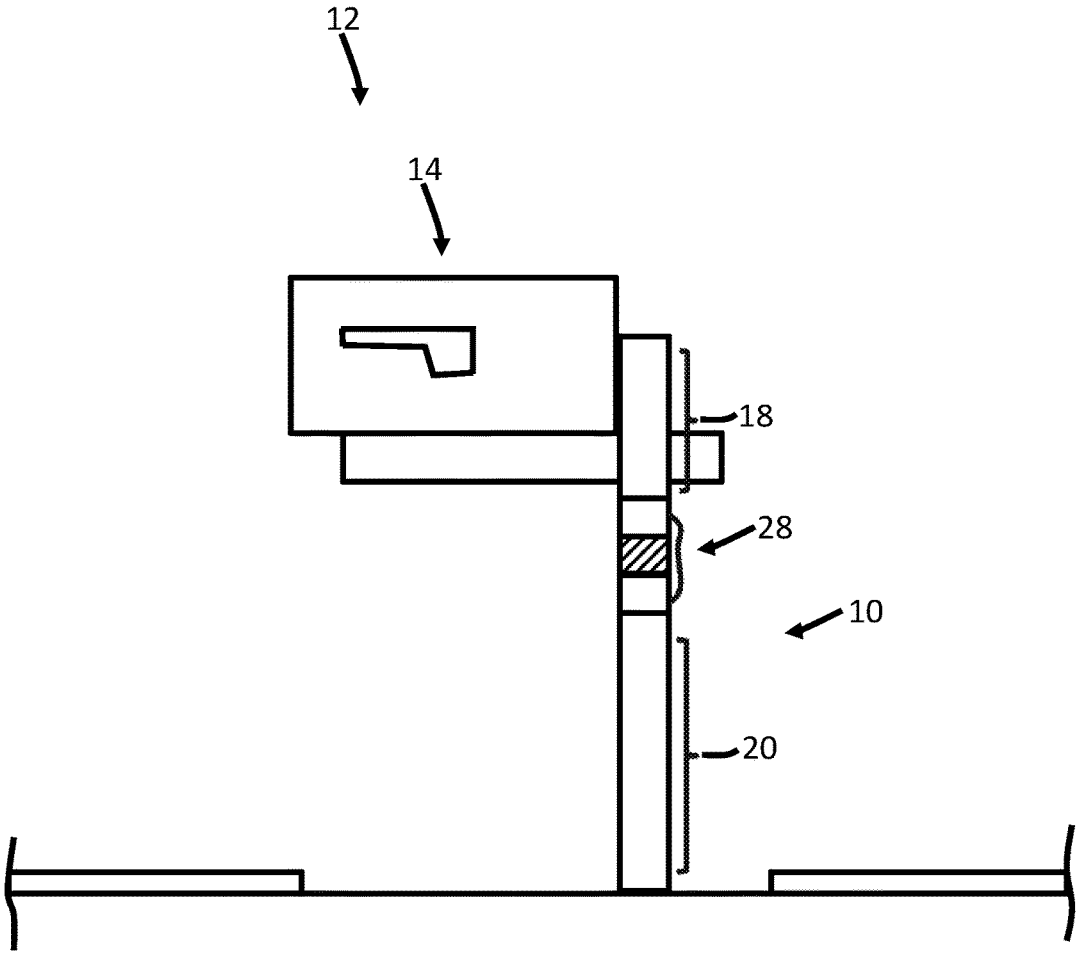
FIG. 7 is an elevation view of a mailbox mounted on another flexible mailbox support.

The support 10 has a total height (i.e., a dimension in a vertical direction) that is selected so that the mailbox 14, when mounted on the support 10, will be positioned at a convenient height relative to the ground (e.g., a height corresponding to that of a mail carrier vehicle window). The total height is substantially equal to the sum of the respective heights of the bottom end portion 20 of the support 10, the top end portion 18 of the support 10, and the joint 28. In some embodiments (see FIG. 2), the height of the top end portion 18 of the support 10 is greater than the height of the bottom end portion 20 of the support 10. In other embodiments (see FIG. 7), the height of the bottom end portion 20 is greater than the height of the top end portion 18.

Figure 8:
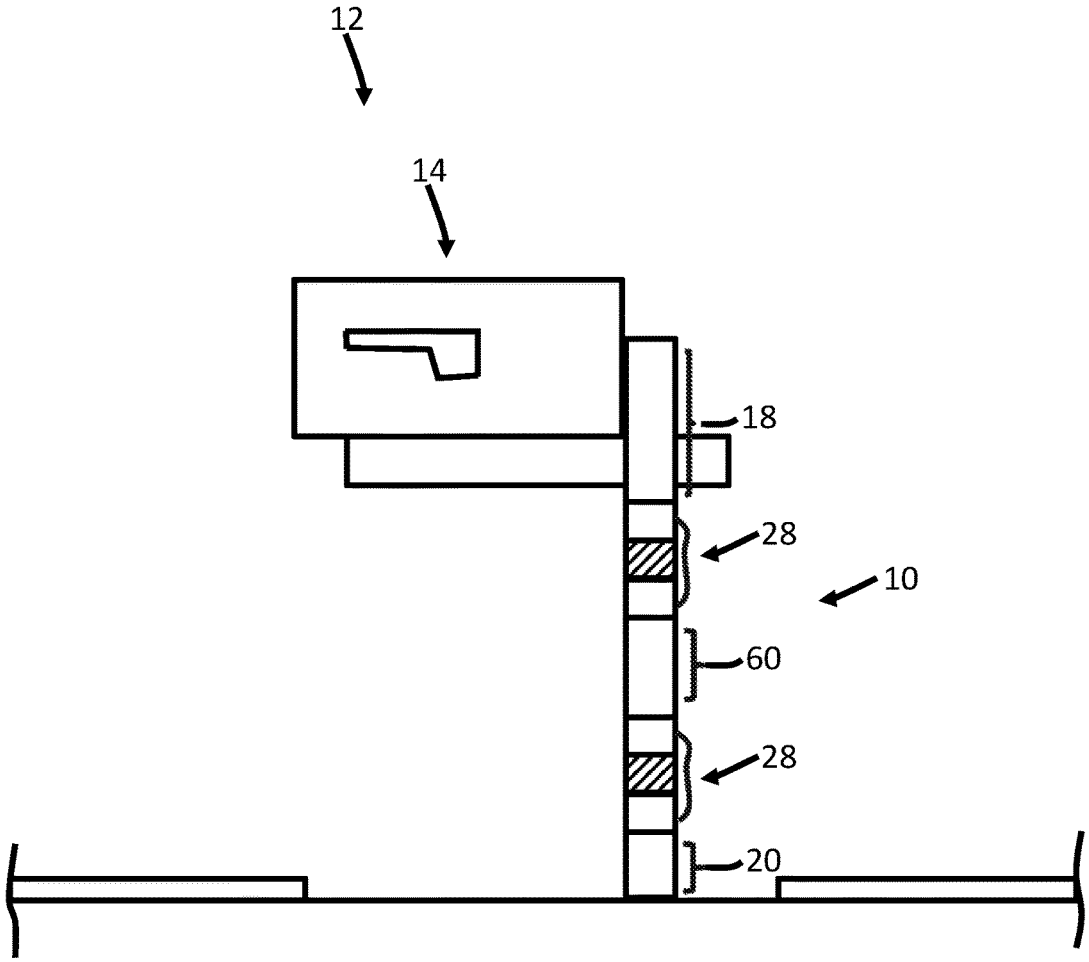
FIG. 8 is an elevation view of a mailbox mounted on another flexible mailbox support.

In some embodiments, the support 10 includes more than one joint 28. In the embodiment illustrated in FIG. 8, for example, the support 10 includes a first joint 28*a* between the top end portion 18 and an intermediate portion 60 of the support 10, and a second joint 28*b* between the intermediate portion 60 and the bottom end portion 20 of the support 10.

While several embodiments have been disclosed, it will be apparent to those having ordinary skill in the art that aspects of the present invention include many more embodiments. Accordingly, aspects of the present invention are not to be restricted except in light of the attached claims and their equivalents. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

What is claimed is:

1. A flexible mailbox support, comprising:

a top end portion;

a bottom end portion;

a joint enabling the top end portion to pivot relative to the bottom end portion when impacted by a force, such that respective longitudinal axes of the top and bottom end portions of the support are angularly offset relative to one another; and a safety link connecting the top end portion to the bottom end portion;

wherein the joint includes a top joint housing connected to the top end portion and a bottom joint housing connected to the bottom end portion; and wherein the safety link connects the top joint housing and the bottom joint housing.

2. The flexible mailbox support of claim 1, wherein the joint further includes a joint spring connecting the top joint housing and the bottom joint housing.

3. The flexible mailbox support of claim 1, wherein the joint enables the flexible mailbox support to move between an unbent state and a bent state;

wherein in the unbent state, the respective longitudinal axes of the top and bottom end portions of the flexible mailbox support are at least substantially aligned with one another; and wherein in the bent state, the respective longitudinal axes of the top and bottom end portions of the flexible mailbox support are angularly offset relative to one another.

4. The flexible mailbox support of claim 1, wherein the top and bottom joint housings of the joint each include a base plate and one or more sidewalls that extend from the base plate to define a cavity.

5. The flexible mailbox support of claim 4, wherein the top end portion of the flexible mailbox support is received within the cavity of the top joint housing, and the bottom end portion of the flexible mailbox support is received within the cavity of the bottom joint housing.

6. The flexible mailbox support of claim 4, wherein the sidewalls are configured to flex relative to the respective base plates.

7. The flexible mailbox support of claim 4, wherein the top and bottom joint housings each have a square cross-sectional shape defined by the respective sidewalls thereof.

8. The flexible mailbox support of claim 1, wherein the safety link is connected to the top and bottom joint housings via fasteners.

9. The flexible mailbox support of claim 1, wherein the top end portion is pivotable within a semicircular pivot area having a radius.

10. The flexible mailbox support of claim 1, wherein the joint is a first joint and the flexible mailbox support further comprises a second joint; and wherein the first joint extends between the top end portion and an intermediate portion of the flexible mailbox support, and the second joint extends between the intermediate portion and the bottom end portion of the flexible mailbox support.

11. The flexible mailbox support of claim 1, wherein the flexible mailbox support has a total height that is substantially equal to a sum of the respective heights of the bottom end portion, the top end portion, and the joint; and wherein the height of the top end portion is greater than the height of the bottom end portion.

12. The flexible mailbox support of claim 1, wherein the flexible mailbox support has a total height that is substantially equal to a sum of the respective heights of the bottom end portion, the top end portion, and the joint; and wherein the height of the top end portion is less than the height of the bottom end portion.

13. A flexible mailbox support, comprising:

a top end portion;

a bottom end portion;

a joint enabling the top end portion to pivot relative to the bottom end portion when impacted by a force, such that respective longitudinal axes of the top and bottom end portions of the support are angularly offset relative to one another; and a safety link connecting the top end portion to the bottom end portion;

wherein the joint includes a top joint housing connected to the top end portion and a bottom joint housing connected to the bottom end portion;

wherein the top and bottom joint housings of the joint each include a base plate and one or more sidewalls that extend from the base plate to define a cavity;

wherein the top and bottom joint housings each have a square cross-sectional shape defined by the respective sidewalls thereof; and wherein each of the respective sidewalls is separated from an adjacent sidewall by a gap.

14. The flexible mailbox support of claim 4, wherein fasteners are positioned on each of four sides of the respective sidewalls; and wherein the safety link is removably connectable to different sides of the top and bottom joint housings depending on a desired orientation of a pivot area of the flexible mailbox support.

15. The flexible mailbox support of claim 4, wherein the joint further includes a joint spring fastened between the respective base plates of the top and bottom joint housings.

16. The flexible mailbox support of claim 4, wherein each of the sidewalls includes at least one hole configured to receive a bolt, and each end of the safety link has a loop configured to be connected to the bolt.

17. A flexible mailbox support, comprising:

a top end portion;

a bottom end portion;

a joint enabling the top end portion to pivot relative to the bottom end portion when impacted by a force, such that respective longitudinal axes of the top and bottom end portions of the support are angularly offset relative to one another; and a safety link connecting the top end portion to the bottom end portion;

wherein the safety link has a length and a strength sufficient to prevent the top end portion of the flexible mailbox support from pivoting relative to the bottom end portion in a direction perpendicular to the respective surfaces of the sidewalls that are opposite the safety link; and wherein the top end portion of the flexible mailbox support is pivotable relative to the bottom end portion in all other directions not constrained by the safety link.

18. A system, comprising:

a mailbox; and a flexible mailbox support on which the mailbox is mounted, the flexible mailbox support including:

a top end portion;

a bottom end portion;

a joint enabling the top end portion to pivot relative to the bottom end portion when impacted by a force, such that respective longitudinal axes of top and bottom end portions of the support are angularly offset relative to one another; and a safety link connecting the top end portion to the bottom end portion;

wherein the joint includes a top joint housing connected to the top end portion and a bottom joint housing connected to the bottom end portion; and wherein the safety link connects the top joint housing and the bottom joint housing.

* * * * *